United States Patent [19]

Herder

[11] 4,260,114

[45] Apr. 7, 1981

[54] SAFETY DEVICE FOR BRUSH CHIPPER

[75] Inventor: Robert R. Herder, Bryn Athyn, Pa.

[73] Assignee: Asplundh Tree Expert Company, Willow Grove, Pa.

[21] Appl. No.: 84,045

[22] Filed: Oct. 12, 1979

[51] Int. Cl.[3] ..... B02C 25/00

[52] U.S. Cl. ..... 241/37.5; 241/101.7; 241/277

[58] Field of Search ..... 241/60, 37.5, 101.7, 241/277, 282.1, 189 R, 33; 83/DIG. 1

[56] References Cited

U.S. PATENT DOCUMENTS 3,841,571 10/1974 Dankel et al. ..... 241/37.5 X 3,944,147 3/1976 Pletcher ..... 241/60

*Primary Examiner*—Mark Rosenbaum

*Attorney, Agent, or Firm*—John W. Logan, Jr.

[57] ABSTRACT

A brush chipper having a guard (38) which is released to block the inlet (12) to the cutter (10) when an emergency condition is sensed. During normal operation of the chipper, the guard (38) is held out of the path of brush to the cutter (10). When a weight, in excess of a normal brush load, is sensed, as for example when the chipper operator is being drawn into the chipper, the guard (38) is released automatically and moves to block the inlet (12) to the cutter (10). This prevents the operator from being drawn into the cutter (10).

15 Claims, 4 Drawing Figures

SAFETY DEVICE FOR BRUSH CHIPPER

DESCRIPTION

Technical Field

The present invention relates, in general, to brush chippers which reduce the volume of the branches and similar debris by cutting the brush into small chips and, in particular, to brush chippers provided with a safety device which prevents an operator of the chipper from being pulled into the cutter portion of the chipper.

Background Art

As a result of various tree pruning, land clearing and similar operations, tree limbs and similar debris referred to as brush are provided and should be reduced in volume to facilitate its handling and disposal. At the present time, brush chippers are utilized to cut the brush into small chips which can be deposited in an easily handled pile and utilized for natural recycling as mulch or ground cover or which can be utilized for pulp in making paper. One type of brush chipper which has been effectively used includes a housing having an inlet opening and an outlet opening in communication with a discharge chute. Carried in the housing is a cutter bar and a rotor assembly including a plurality of cutting blades which cooperate with the cutter bar for cutting brush fed through the inlet opening into small chips and for discharging the chips through the outlet opening into the discharge chute. A blower is usually associated with the discharge chute for facilitating the convevance of chips through the chute. U.S. Pat. No. 3,944,147 illustrates a brush chipper of the type just described.

Safety for the operator of a brush chipper is a major concern. Besides the hazards which might be attributable to the carelessness of the operator, there are some which occur through no real fault on the part of anyone. For example, a tree limb having many branches may catch on the belt or belt loop of the operator and drag the operator into the cutter portion of the chipper. The present invention is directed to protecting the operator whether the hazard is caused by his carelessness or by an incident far more difficult to anticipate.

For the most part, efforts in the past to provide safety features in brush chippers have involved manually operated brake mechanisms. These units have been designed in such a way that an operator, exposed to an emergency condition, manually actuates a brake as he is being dragged toward the cutter. Generally, these prior attempts have suffered from three shortcomings. First, the safety feature is not positive in the sense that it requires shut-down of the cutter rather than prevention of the operator reaching the cutter. Second, by requiring manual actuation, in a hazard situation, there is the possibility that an operator is so preoccupied with his safety that he may not actuate the brake mechanism in time. Third, because the cutting function requires massive cutter members, the inertia of the cutter members either prevents quick enough stopping or causes damage or destruction of various components, such as the drive shaft of the chipper, when the brake mechanism is actuated. Furthermore, operators of brush chippers having manually actuated emergency brakes tend to use the emergency shut-down feature by actuating the brake mechanism, rather than the normal shut-off switch, because normal shut-down may take as long as ten minutes due to the inertia of the cutters members.

This results in undue exposure of various components of the chipper to damage and destruction.

DISCLOSURE OF INVENTION

Accordingly, it is an object of the invention to provide a new and improved brush chipper.

It is another object of the present invention to provide a brush chipper having a safety device which is effective in preventing an operator of the chipper from being dragged into the cutter of the chipper.

It is yet another object of the present invention to provide a brush chipper which is relatively simple in construction.

It is a further object of the present invention to provide a brush chipper which may be fabricated at reasonable cost.

A brush chipper, constructed in accordance with the present invention, includes a cutter housing and cutting means within the housing for cutting brush into small chips. Brush to be chipped is supplied to the cutting means from feed means which communicate with the cutter housing through an inlet opening. Chips are carried away from the cutting means through discharge means which communicate with the cutter housing through an outlet opening. Also included in the brush chipper are guard means movably mounted forward of the cutting means for obstructing the supply of brush to the cutting means during an emergency condition. The guard means are movable between a normal position at which the supply of brush to the cutting means is unobstructed and an emergency position within the path of movement of the brush to the cutting means to obstruct the supply of brush. The brush chipper further includes control means coupled to the guard means for holding the guard means in its normal position and, upon actuation, for releasing the guard means to permit movement to the emergency position.

BRIEF DESCRIPTION OF THE DRAWINGS

Referring to the drawings.

BEST MODE OF CARRYING OUT THE INVENTION

U.S. Pat. No. 3,944,147 is incorporated herein by reference to supplement the disclosure of various components of a brush chipper which do not form part of the present invention.

Figures 1, 2, 4:
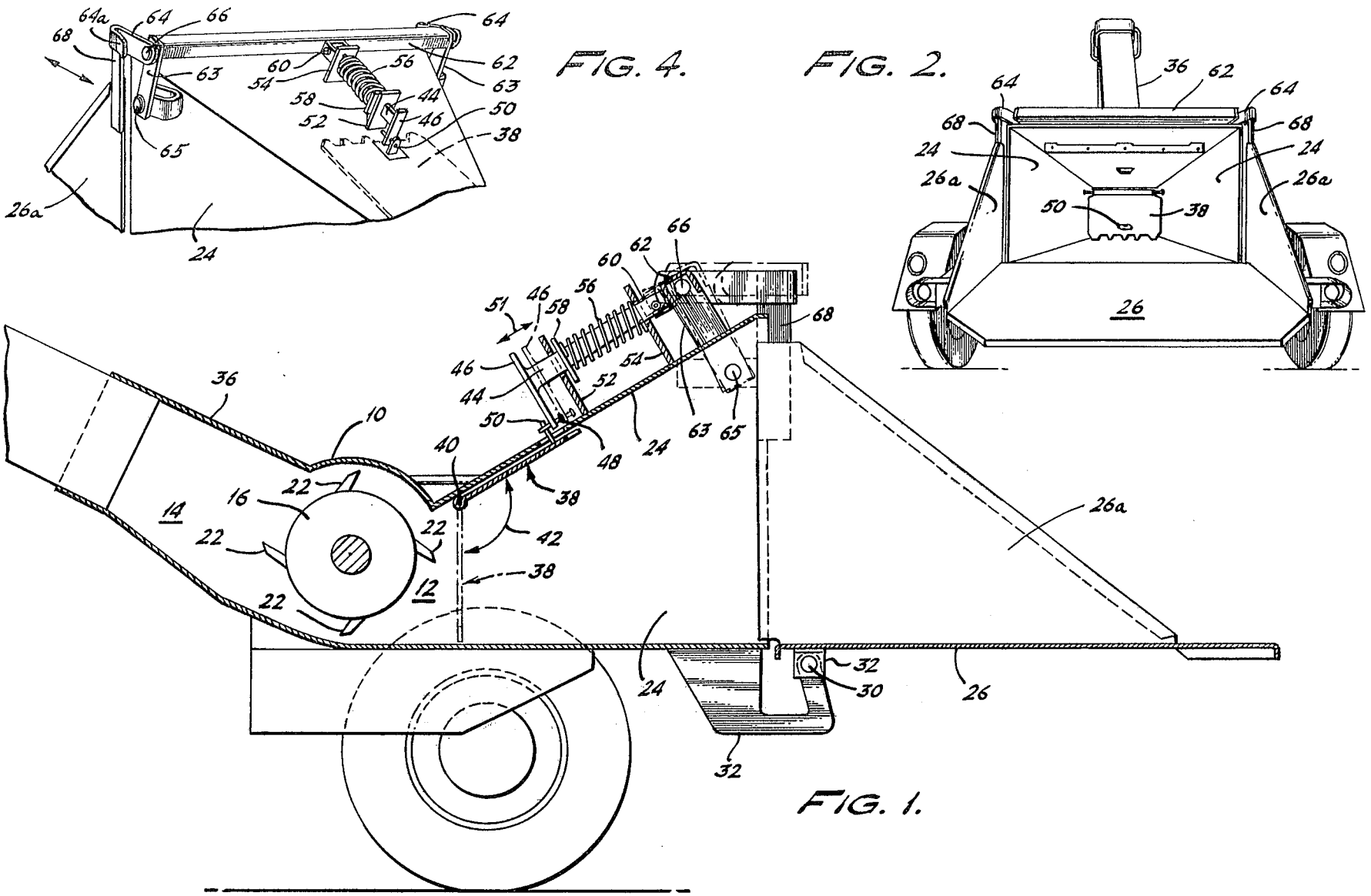
FIG. 1 is a sectional view of a brush chipper constructed in accordance with the present invention with the safety guard in its normal position.
FIG. 2 is an end view of a brush chipper constructed in accordance with the present invention with the safety guard in its emergency position.
FIG. 4 is a perspective view of a portion of the brush chipper of FIGS. 1, 2 and 3 and shows the details of the mechanism which controls the operation of the safety guard.
Figure 3:
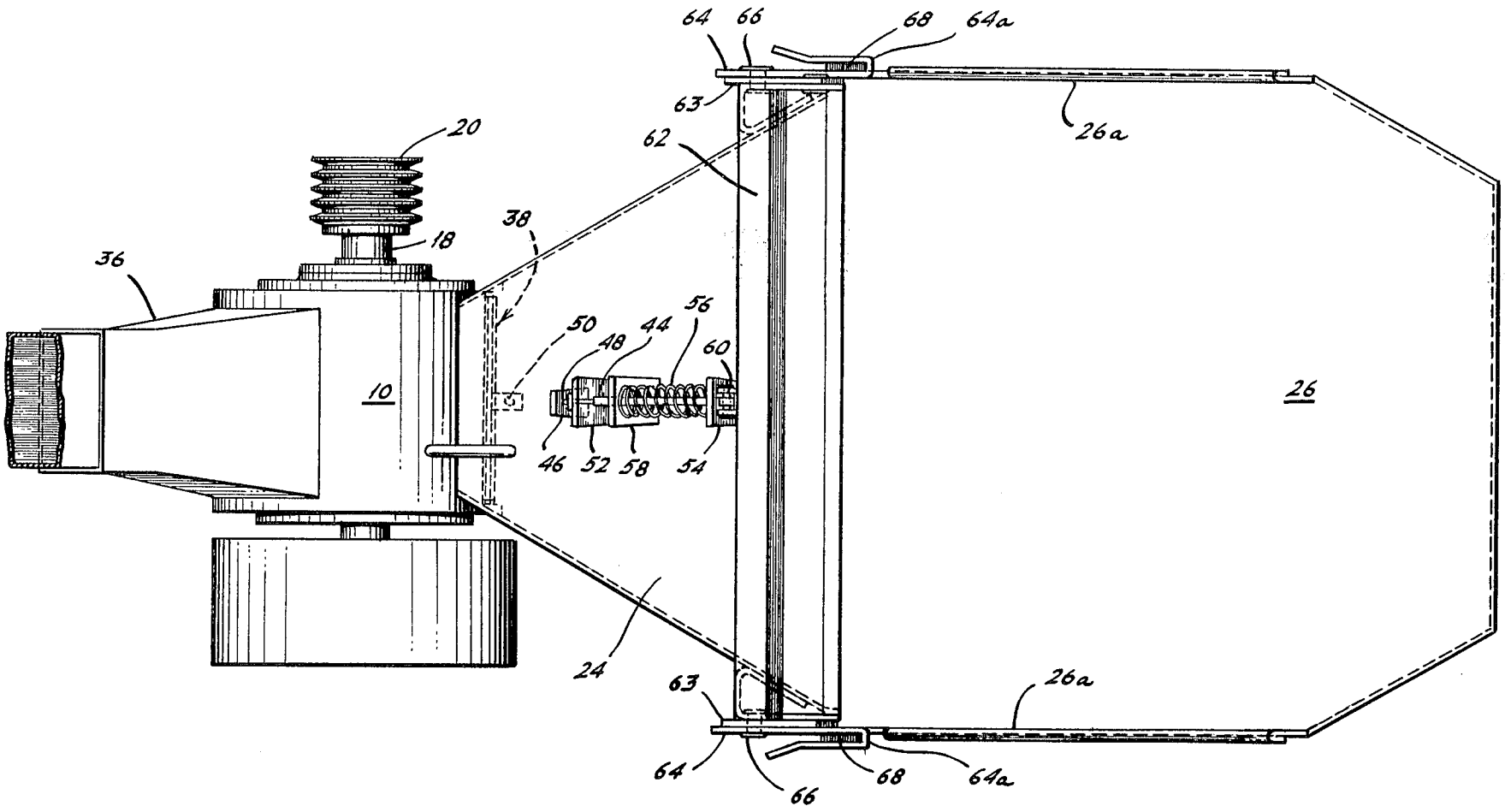
FIG. 3 is a top view of the brush chipper of FIGS. 1 and 2.

Referring to FIGS. 1 and 3, a brush chipper constructed in accordance with the present invention includes a cutter housing 10 having an inlet opening 12 and an outlet opening 14. Located within cutter housing 10 are cutting means for cutting brush, fed through inlet opening 12, into small chips. The cutting means may include a rotor 16 carried on a shaft 18 centrally located within housing 10 and extending through the end walls thereof. One end of shaft 18 fixedly carries a sheave 20 to which drive is imparted to turn rotor 16. Secured to the rotor are a plurality of cutting blades 22. Additional details about the cutting means and the apparatus for driving the cutting means may be obtained from U.S. Pat. No. 3,944,147.

The brush chipper of the present invention also includes feed means communicating with the housing 10 through inlet opening 12 for supplying brush to the cutting means. The feed means may include a feed chute 24 and a feed table 26 over which brush is supplied. Feed table 26 has side walls 26*a*. During normal operation of the brush chipper, feed table 26, in effect, is an extension of chute 24 and serves to funnel brush into the chute.

As best seen in FIG. 1, the feed table is mounted for movement between a normal position, illustrated in FIG. 1, at which a normal load of brush has been deposited on the table and an emergency position at which a weight in excess of a normal load of brush has been deposited on the table. Feed table 26 is mounted for pivotal movement about a rod 30 which is held in place by a pair of brackets 32 secured to the bottom of chute 24 and near its sidewalls. The feed table is secured to a pair of bushings 34 which are mounted for rotational movement about rod 30. As weight is applied to feed table 26, it tends to rotate clockwise, as viewed in FIG. 1, about rod 30.

The brush chipper, constructed in accordance with the present invention, further includes discharge means communicating with housing 10 through outlet opening 14 for carrying away chips from the cutting means. The discharge means may include a discharge chute 36 extending upwardly and away from outlet opening 14 for conveying chips, discharged by the cutter, to an appropriate storage device. If, as is usual, the brush chipper is mounted on a trailer hitched to a truck, the storage device is the enclosed bed of the truck. FIGS. 1 and 2 illustrate the brush chipper mounted on a trailer. Additional details about the mounting of the chipper may be obtained from U.S. Pat. No. 3,994,147.

The brush chipper of the present invention also includes guard means movably mounted forward of the cutting means for obstructing the supply of brush to the cutting means during an emergency condition. For the embodiment of the invention illustrated, such means include a plate 38 shaped and sized approximately equal to inlet opening 12. Plate 38 is pivotally movable about a rod 40 between a normal position, shown in solid lines in FIG. 1 and dotted lines in FIG. 4, at which the plate does not obstruct the supply of brush to the cutting means, and an emergency position, shown in solid lines in FIG. 2 and dotted lines in FIGS. 1 and 3, within the path of movement of the brush to the cutting means to obstruct the supply of brush to the cutting means. Rod 40, the pivot for plate 38, is secured along the top edge of inlet opening 12. In its normal position, plate 38 is held adjacent the top surface of chute 24 by means which will be described shortly. During an emergency condition, plate 38 is released to permit movement to the emergency position. This movement, clockwise as viewed in FIG. 1, is in the direction of movement of the brush from feed table 26 and feed chute 24 to the cutting means. This arrangement causes plate 38 to be drawn with the brush toward the cutting means as the brush is being drawn by the cutting means and, thereby, close off inlet opening 12. The plate moves with the brush until the brush becomes wedged between the bottom edge of the plate and the bottom surface of chute 24. The final position of plate 38 is determined by the size of the brush wedged between the plate and chute 24. By limiting the use of the chipper to the brush for which it is intended, plate 38 will drop to either the absolute vertical position shown dotted in FIGS. 1 and 3 or to a position very close to the vertical. In order to enhance the engagement of the bottom edge of plate 38 and the brush, the bottom edge of the plate preferably is toothed as shown in FIG. 2. Double-ended arrow 42 indicates the bi-directional movement of plate 38 to the emergency position when an emergency condition exits and to the normal position when the plate is set for normal cutting and chipping.

The brush chipper, constructed in accordance with the present invention, further includes control means coupled to the guard means for holding the guard means in the normal position and, upon actuation, for releasing the guard means to permit movement of the guard means to the emergency position. For the embodiment of the invention illustrated in the drawings, the control means include a rod assembly having a rod 44, a plate 46 carried at one end of rod 44 and a pin 48 carried by plate 46. The rod assembly is movable between a first position at which pin 48 engage a lug 50 which is secured to the back of plate 38 and extends through an opening in chute 24 and a second position at which pin 48 is disengaged from lug 50. Such movement is represented in FIG. 1 by a double-ended arrow 51 and showing plate 46 dotted in its second position at which pin 48 is disengaged from lug 50 and plate 38 is released and permitted to move into its emergency position.

Rod 44 is movable along its axis through openings in a pair of posts 52 and 54. A spring 56, in the form of a coil spring, surrounds rod 44 and urges the rod to its first position at which pin 48 engages lug 50. Specifically, spring 56 is in compression between post 54 and a plate 58 secured to rod 44. With such a spring bias, rod 44 is urged to its first position at which plate 58 abuts post 52. The location of plate 58 relative to post 52 in FIG. 3 represents the rod assembly in its second position. Such movement occurs when a force is applied to rod 44 adequate to cause further compression of spring 56. The spring is designed to undergo this further compression when a force slightly in excess of the weight of a normal load of brush is applied to rod 44.

The end of rod 44 opposite from the end which carries plate 46 and pin 48 is pivotally pinned to a bracket 60 which, in turn, is secured to a frame member 62. The frame member is pivotally secured at its ends to a pair of pivot arms 63 and a pair of brackets 64 at the sidewalls of chute 24. Pivot arms 63 pivot about pins 65 and brackets 64 pivot about pins 66 which are the pins by which pivot arms 63 and brackets 64 are secured to frame member 62. Each of the brackets 64 has a return bend 64*a* into which is fitted an extension 68 of feed table 26.

When a weight, in excess of a normal load of brush, is deposited on feed table 26, for example when an operator of the brush chipper becomes entangled in the brush and is drawn by the brush onto the feed table, the table pivots clockwise about rod 30, in turn, causing extensions 68 to move brackets 64 and pivot arms 63 to the positions shown in dotted lines in FIG. 1. This moves frame member 62 away from post 54 and moves rod 44, against the action of spring 56, to disengage pin 48 from lug 50. Plate 38 now is free to drop from its normal position adjacent the top surface of chute 24 to its emergency position blocking inlet opening 12.

Although the cutter continues to rotate after plate 38 has dropped to its emergency position and the brush has been wedged between the plate and chute 24, the operator is protected in two ways. First, with the brush no longer being drawn toward the cutter, the operator is no longer drawn toward the cutter. Second, with plate 38 blocking inlet opening 12, the plate serves to prevent any part of the operator's body from coming into contact with the cutter.

While in the foregoing there has been described a preferred embodiment of the invention, it should be understood to those skilled in the art that various modifications and changes can be made without departing from the true spirit and scope of the invention as recited in the claims.

I claim:

1. A brush chipper comprising:

a cutter housing having an inlet opening and an outlet opening;

cutting means within said cutter housing for cutting brush, fed through said inlet opening, into small chips;

feed means communicating with said housing through said inlet opening for supplying brush to said cutting means, said feed means including a feed table over which brush is supplied and movable between a normal position at which a normal load of brush has been deposited on said table and an emergency position downward from said normal position at which a weight in excess of a normal load of brush has been deposited on said table;

discharge means communicating with said housing through said outlet opening for carrying away chips from said cutting means;

guard means movably mounted forward of said cutting means for obstructing the supply of brush to said cutting means during an emergency condition, said guard means movable between a normal position at which said guard means do not obstruct said supply of brush to said cutting means and an emergency position within the path of movement of said brush to said cutting means to obstruct said supply of brush to said cutting means; and, control means coupled between said guard means and said feed means for holding said guard means in said normal position of said guard means and, upon downward movement of said feed table to said emergency position of said feed table, for releasing said guard means to permit said guard means to move to said emergency position of said guard means.

2. A brush chipper according to claim 1 wherein the control means include a rod assembly movable between a first position at which said rod assembly engages said guard means to hold said guard means in its normal position and a second position at which said rod assembly is disengaged from said guard means to release said guard means to its emergency position.

3. A brush chipper according to claim 2 wherein the control means also include a spring biased to urge the rod assembly to the first position and the bias of said spring is set at a level slightly in excess of the weight of a normal load of brush.

4. A brush chipper according to claim 1 wherein the guard means include a plate shaped and sized approximately equal to the inlet opening and mounted for pivotal movement along the top edge of said inlet opening between the normal position of said guard means and the emergency position of said guard means.

5. A brush chipper according to claim 4 wherein the feed means include a chute located between the cutter housing and the table and the normal position of the plate is adjacent a surface of said chute.

6. A brush chipper according to claim 5 wherein the plate is mounted for pivotal movement at its top edge and the bottom edge of said plate is toothed.

7. A brush chipper according to claim 6 wherein the control means include a rod assembly movable between a first position at which said rod assembly engages the plate to hold said plate adjacent the chute and a second position at which said rod assembly is disengaged from said plate to release said plate to its emergency position.

8. A brush chipper according to claim 7 wherein the control means also include a spring biased to urge the rod assembly to its first position and the bias of said spring is set at a level slightly in excess of the weight of a normal load of brush.

9. A brush chipper according to claim 5 wherein the plate has a lug which extends through an opening in the chute to engage the control means.

10. A brush chipper according to claim 7 wherein the table is mounted for pivotal movement between its normal position and its emergency position.

11. A brush chipper comprising:

a rotary cutter for drawing brush to be chipped, cutting said brush into small chips and discharging said chips;

a housing surrounding said cutter and having an inlet through which said brush is drawn and an outlet through which said chips are discharged;

a rigid safety guard movably mounted on the opposite side of said inlet from said cutter, said guard movable in the direction of movement of said brush from a first position which leaves said inlet unobstructed to a second position at which said guard blocks said inlet;

retaining means coupled to said guard for holding said guard in said first position; and, release means movably mounted and coupled to said retaining means for sensing the presence of a weight in excess of the weight of a normal load of brush deposited on said release means and for moving said retaining means to uncouple said retaining means from said guard when said excess weight is sensed, whereby said guard is released from said first position and moves to said second position.

12. A brush chipper according to claim 11 wherein the rigid safety guard has a first edge adapted to engage the brush drawn by the rotary cutter when the retaining means are uncoupled from said guard, whereby said guard is drawn with said brush toward said cutter.

13. A brush chipper according to claim 12 wherein the release means includes a feed table over which brush is supplied and pivotally movable between a normal position at which a normal load of brush has been deposited on said table and an emergency position at which a weight in excess of a normal load of brush has been deposited on said table.

14. A brush chipper according to claim 13 wherein the retaining means include a rod and a spring, said rod movable axially thereof between a first position to which it is urged by said spring and a second position to which it is moved by movement of the feed table to its emergency position in opposition to said spring.

15. A brush chipper according to claim 14 wherein the spring is a coil spring in compression which surrounds the rod.

* * * * *